United States Patent [19]

Knickerbocker et al.

[11] Patent Number: 5,040,702

[45] Date of Patent: Aug. 20, 1991

[54] MANUALLY ACTUATED DISPENSING PUMP SPRAYER HAVING A REMOVABLE NOZZLE LOCKING ELEMENT

[75] Inventors: Michael G. Knickerbocker, Upland; R. Kevin O'Neill, Wrightwood; Douglas B. Dobbs, Yorba Linda, all of Calif.

[73] Assignee: Calmar Inc., Watchung, N.J.

[21] Appl. No.: 579,618

[22] Filed: Sep. 7, 1990

Related U.S. Application Data

[62] Division of Ser. No. 360,286, Jun. 2, 1989, Pat. No. 4,971,227.

[51] Int. Cl.[5] ..... B67D 5/32

[52] U.S. Cl. ..... 222/153; 215/254; 222/380; 222/383

[58] Field of Search ..... 222/153, 182, 321, 380, 222/383, 384, 402.11, 541; 215/254, 256; 220/266; 239/333

[56] References Cited

U.S. PATENT DOCUMENTS

| | | | |
|---|---|---|---|
| 3,850,329 | 11/1974 | Robinson | 215/254 |
| 3,884,393 | 5/1975 | Wassilieff | 222/153 |
| 3,901,404 | 8/1975 | Feldman | 215/256 |
| 3,971,488 | 7/1976 | McRoskey et al. | 215/254 |
| 3,980,195 | 9/1976 | Fillmore | 215/256 |
| 4,204,614 | 5/1980 | Reeve | 222/383 X |

*Primary Examiner*—Kevin P. Shaver

*Attorney, Agent, or Firm*—Watson, Cole, Grindle & Watson

[57] ABSTRACT

In a manually actuated sprayer having a nozzle rotatable from OFF to ON positions, a removable tear strip or a removable cap is provided for preventing rotation from the OFF position. Upon removal of the tear strip or cap, the nozzle is free to be rotated to its ON position.

2 Claims, 4 Drawing Sheets

MANUALLY ACTUATED DISPENSING PUMP SPRAYER HAVING A REMOVABLE NOZZLE LOCKING ELEMENT

This application is a divisional application of application Ser. No. 360,286 filed June 2, 1989 now U.S. Pat. No. 4,971,227.

BACKGROUND OF THE INVENTION

This invention relates generally to a manually actuated pump sprayer having a nozzle rotatable between discharge open and discharge closed positions, and more particularly to such a sprayer having an element for locking the nozzle in its discharge closed position, the element being removable permitting rotation of the nozzle from its closed position.

Manually operated pump sprayers of the general type to which the invention pertains include locking mechanisms of various types to prevent rotation of the nozzle from its discharge closed position. For example, U.S. Pat. No. 4,516,695 discloses a child-resistant liquid sprayer having a nose bushing with a hinged lock engageable with a notch in the nozzle cap for locking the nozzle cap against turning from its discharge closed position.

U.S. Pat. No. 4,346,821 discloses an overcap at the nozzle end of a manually operated liquid sprayer for selectively opening and closing the outlet orifice.

U.S. Pat. Nos. 4,204,614 and 4,257,561 disclose safety nozzle caps for manually actuated liquid sprayers in the form of a spring locking tab on the pump body which engages a slot or a shoulder on the nozzle cap for locking it in its discharge closed position.

U.S. Pat. No. 3,884,393 discloses a reciprocable distributing cap for an aerosol can, the cap being turnable between a closed position in which axial movement between the cap and an intermediate member is prevented and an open position in which relative axial movement may take place to operate the aerosol valve. The cap has a removable locking element for initially maintaining it in its closed position.

Also, removable tear tabs are provided for locking closure caps for milk cartons or the like in a threadedly closed position on the bottle neck.

SUMMARY OF THE INVENTION

It is an object of the present invention to provide a manually actuated liquid dispensing pump having a discharge nozzle mounted on the pump body adjacent a forward end of a shroud cover provided for the body, the nozzle being rotatable between discharge open and closed positions, and an improved removable locking element provided for preventing rotation of the nozzle from its discharge closed position. Upon removal of the locking element the nozzle may be rotated from the discharge closed to the discharge opened position.

The locking element is removably mounted one of the shroud cover and the nozzle and engages stop means on the other of the nozzle or the shroud cover. The locking element is removably connected by frangible connecting ties and, in one embodiment, comprises a strip having a finger pull tab. The stop may comprise a flat outer surface of the nozzle when the strip is mounted on the shroud, and may comprise a flat outer surface of the shroud when the strip is mounted on the nozzle. The strip overlies the flat surface in the discharge closed position and bears thereagainst upon any attempted rotation of the nozzle from its closed position.

In another embodiment the locking element comprises a removable cap snap fitted to the nozzle and overlying a flat surface of the shroud cover thereby preventing nozzle rotation from its discharge closed position.

In yet another embodiment the cap overlying the nozzle and functioning as a locking element has inner locking tongues inserted into the nozzle for a snap fit engagement, the cap overlying a flat surface of the shroud cover to prevent nozzle rotation from the discharge closed position.

In yet another embodiment of the invention a protrusion on the shroud cover functions as the stop, and the removable strip engages the protrusion in the discharge closed position of the nozzle.

In still another embodiment the shroud cover is provided with external ratchet teeth, and the strip has internal ratchet teeth in engagement therewith for preventing nozzle rotation from its discharge closed position until the strip is removed.

Other objects, advantages and novel features of the invention will become more apparent from the following detailed description of the invention when taken in conjunction with the accompanying drawings.

DETAILED DESCRIPTION OF THE INVENTION

Figure 1:
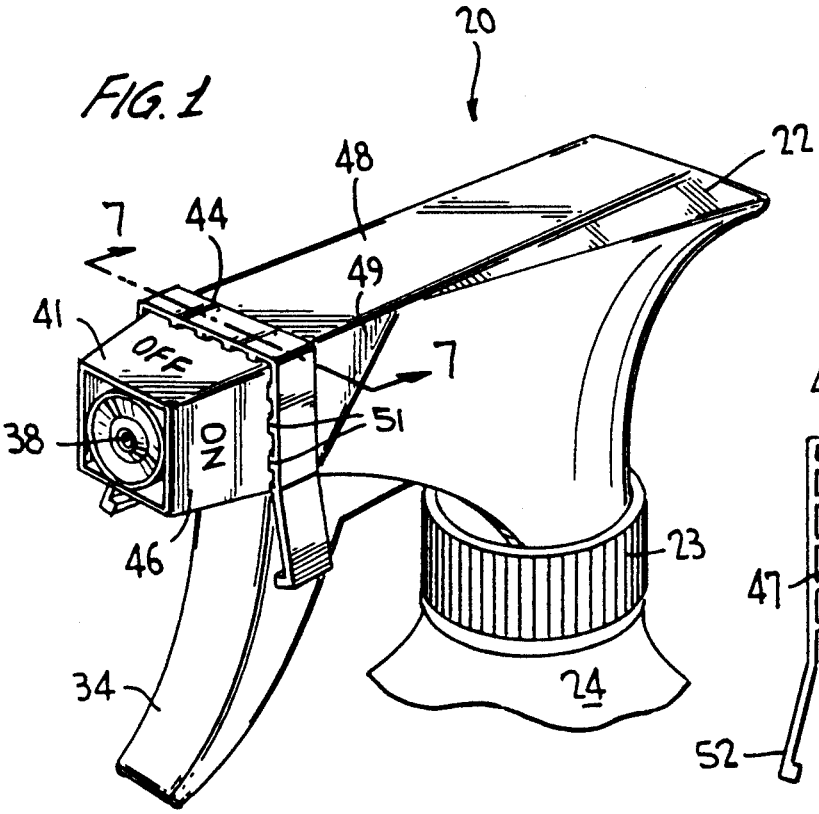
FIG. 1 is a perspective view of a liquid pump sprayer having a removable locking element for the nozzle in accordance with one embodiment of the invention.
Figure 2:
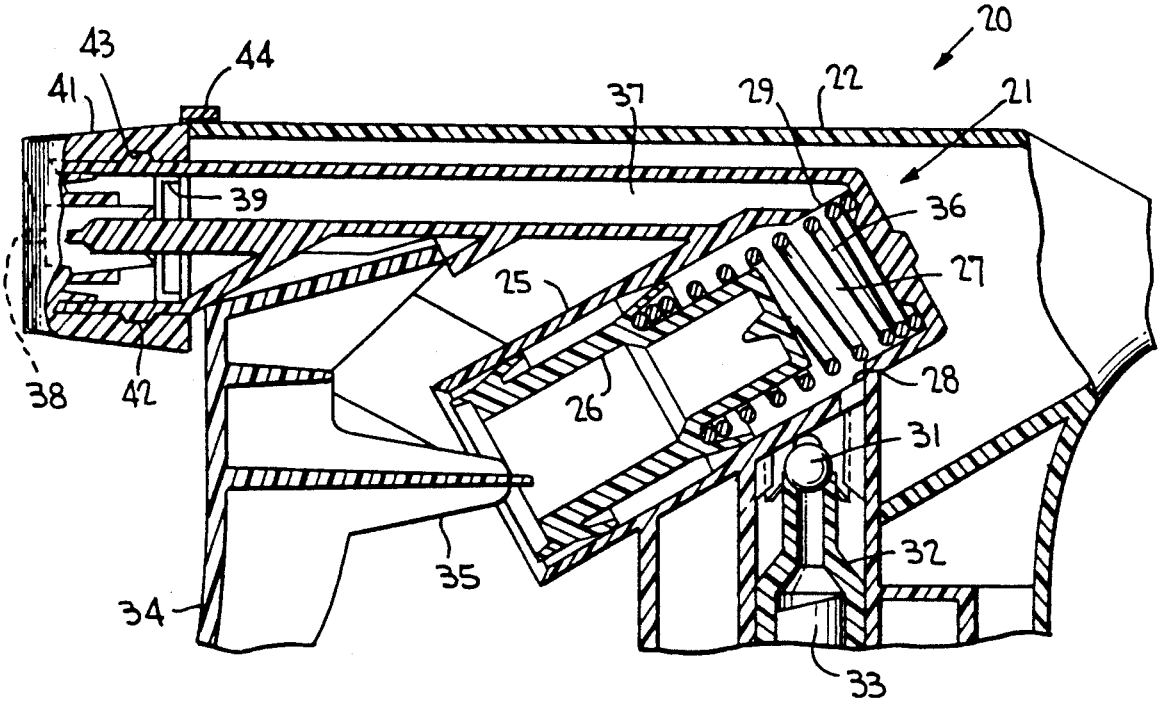
FIG. 2 is a side elevational view of the pump sprayer of FIG. 1, partly in section.

Turning now to the drawings wherein like reference characters refer to like and corresponding parts throughout the several views, the manually actuated pump sprayer incorporating the invention is generally designated 20 in FIGS. 1 and 2 and comprises a pump body 21 and an outer shroud cover 22 surrounding the pump body and mounted thereon in some normal manner. A closure cap 23 on the lower end of the pump body is internally threaded for engagement with the neck of a container 24 of liquid to be dispensed.

The pump body includes a pump cylinder 25 which defines together with a pump piston 26 a pump chamber 27 having an inlet port 28 and a discharge port 29 respectively leading into and out of the chamber. An inlet ball check valve 31 is seated at the upper end of a tube retainer 32 mounted within the pump body and suspending a dip tube 33 which extends into the container.

A trigger actuator 34 is pivotally mounted on the pump body and has a probe 35 bearing against the outer end of piston 26 which, when stroked upon pulling the trigger, is returned to its FIG. 2 position by a return string 36.

The pump body further includes a discharge passage 37 leading from port 29 and communicating with a discharge orifice 38 through a discharge valve 39. The discharge orifice is located in an outer wall of a nozzle cap 41 mounted by a snap fit effected between an external rib 42 on the pump body and an internal groove 43 on the nozzle. The cap is manually rotatable, without axial movement, about its central axis between the OFF position of FIG. 1 and an ON position in which the nozzle is rotated 90° from its OFF position. In this OFF position the discharge is closed and in an ON position the discharge is open as in accordance with the nozzle structure disclosed in U.S. Pat. No. 4,706,888, commonly owned herewith. The entirety of the disclosure of that patent is therefore specifically incorporated herein by reference. In the open discharge position with the nozzle rotated to one of its ON positions, spraying is effected upon repeated pulls on the trigger such that, when the pump chamber is primed with liquid, the liquid in the chamber is compressed during each compression stroke and is expelled through the open discharge. In the OFF position of the nozzle, the discharge is closed even upon actuation of the trigger.

Figure 3:
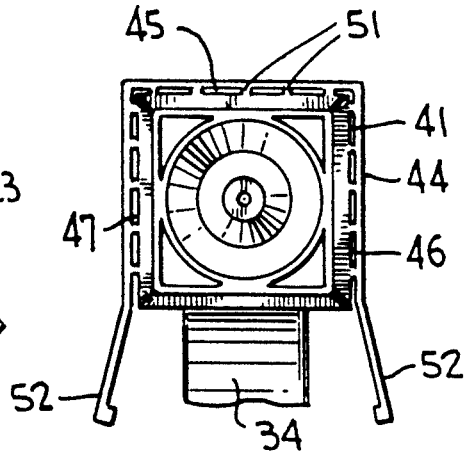
FIG. 3 is a front elevational view of the nozzle and attached locking element of FIG. 1.
Figure 7:
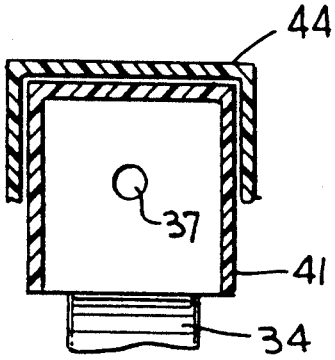
FIG. 7 is a sectional view taken substantially along the line 7—7 of FIG. 1.

In accordance with the invention, the nozzle is locked in the discharge OFF position of FIG. 1 in which the discharge is closed, by the provision of a removable tear strip 44 removably connected as by frangible connecting ties 45 along the edge of at least one flat face 45 of the nozzle. As shown in FIG. 3, the tear strip may be connected by the frangible connecting ties along the edges of all three flat faces 45, 46, 47 of the nozzle having a rectangular cross-section. The strip overlies corresponding flat faces such as 48, 49 (and a flat face opposite 49) formed at the forward end of shroud cover 22 adjacent the nozzle. The strip has one or more outwardly extending pull tabs 51 at opposite ends thereof. And, as more clearly shown in FIG. 7, the tear strip is slightly spaced from the underlying flat faces of the shroud cover.

Figure 4:
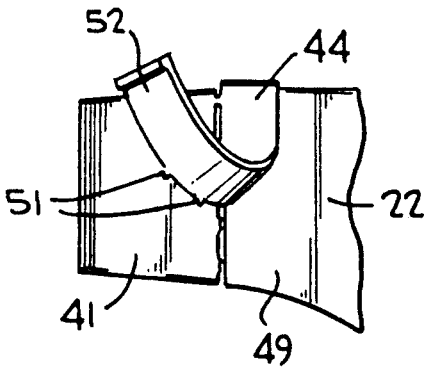
FIG. 4 is a side elevational view of a part of the pump sprayer and nozzle of FIG. 1 showing the process of removing the locking element.

In operation, any attempt to rotate the nozzle about its central rotational axis in either direction out of its discharge closed position, will be prevented by the tear strip abutting at the inner surfaces thereof against the corresponding flat faces of the shroud cover which therefore function as stops preventing nozzle rotation. Thus, the manually operated sprayer on the shelf cannot be tampered with, and cannot be actuated to spray liquid product until the tear strip is removed by grasping one of the pull tabs and exerting a pull force away from the nozzle to remove the tear strip by breaking the frangible ties, as illustrated in FIG. 4.

Figure 5:
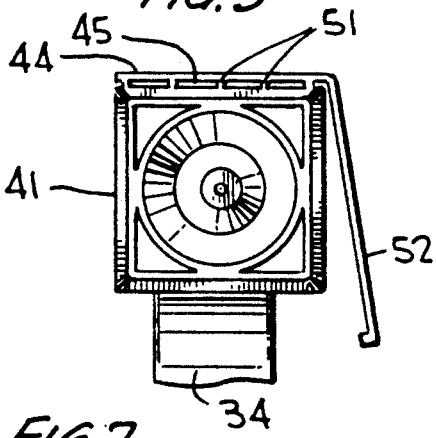
FIG. 5 is a view similar to FIG. 3 in which the locking element is mounted along only one side of the nozzle.

Otherwise, tear strip 44 of FIG. 5 can be removably connected by its frangible connecting ties along an edge of only one of the three faces of the nozzle, such as the upper face 45 thereof. Again, nozzle rotation is prevented from its OFF position by the tear strip which overlies a corresponding flat face 48 of the shroud cover in the same manner as described with reference to FIG. 3. And, the tear strip is capable of being removed by simply grasping pull tab 51 and exerting a force away from the nozzle to break connecting ties 45.

Figure 6:
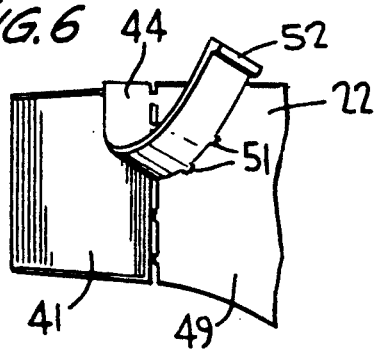
FIG. 6 is a view similar to FIG. 4 of another embodiment in which the locking element is removably mounted on the shroud cover of the pump sprayer.

Alternatively, the tear strip of FIG. 3 may be connected by frangible connecting ties 45 along the edges of the three flat faces (48, 49 and the flat face opposite 49) of the shroud cover, such that the tear strip overlies the corresponding flat faces 45, 46, 47 of the nozzle. Nozzle rotation from the OFF position is similarly prevented as the flat faces 45, 46, 47 of the nozzle acting as stops bear against the corresponding inner flat surfaces of the tear strip. Tear strip removal as shown in FIG. 6 is similarly effected as in FIG. 4 by simply pulling one of the tabs 51 in a direction away from the shroud to break the connecting ties. After the tear strip is fully removed the user simply rotates the nozzle to its ON position in readiness for pump spraying upon squeezing the trigger as more fully described in U.S. Pat. No. 4,706,888.

In the embodiment according to FIGS. 8–11, a cap 53 is proved in lieu of a tear strip for preventing rotation of the nozzle from its OFF position at which the discharge is closed. The nozzle has a pair of opposed outwardly extending ears 54 to effect snap-fit engagement of cap 53 with the nozzle in the FIG. 11 position. The cap is of rectangular cross-section which may or may not have a front wall 55. The inner surfaces of opposing walls 56, 57 have a catch 58 each presenting an internal shoulder which snaps behind ears 54 when cap 53 is inserted over the nozzle. Walls 53 and 54 of the cap overlap flat face 49 of the shroud cover and the opposing flat face 50 of the cover when the cap is fully snap-fitted in place (FIG. 11) to thereby prevent rotation of the nozzle from its OFF position as the inner surfaces of overlapping walls 56, 57 abut against the corresponding flat faces of the shroud cover which act as stops to resist nozzle turning.

Figure 8:
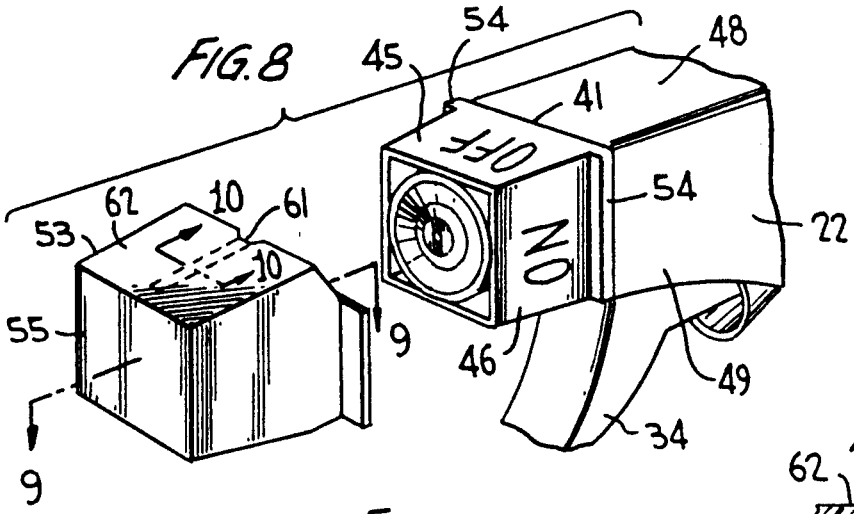
FIG. 8 is a view similar to FIG. 1 showing another embodiment, in expanded view, of the locking element according to the invention.
Figure 10:
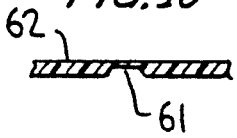
FIG. 10 is a sectional view taken substantially along the line 10—10 of FIG. 8.
Figure 9:
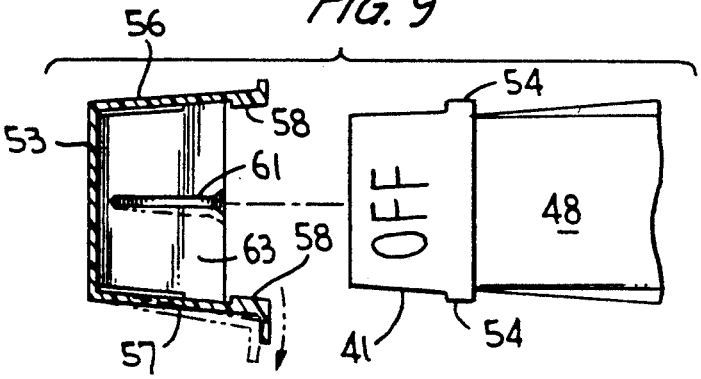
FIG. 9 is a top plan view of FIG. 8 showing the locking element in section.
Figure 11:
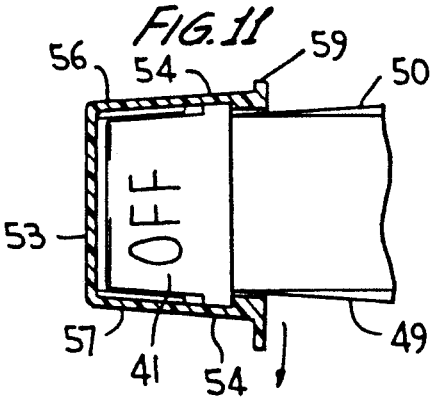
FIG. 11 is a view similar to FIG. 9 with the locking cap shown snapped in place over the nozzle.

Outwardly extending ears 59 on walls 56, 57 of the cap are provided to facilitate cap removal to permit rotation of the nozzle from its OFF position. Cap removal is facilitated by the provision of weakened sections 61 formed in opposing walls 62, 63 of the cap, as shown in FIGS. 8–10. Thus, application of a manual force in a leftward direction when viewed in FIG. 11 causes at least the lower tab to shift outwardly in the direction of the curved arrow shown as permitted by weakened sections 61 to facilitate cap removal.

Figure 14:
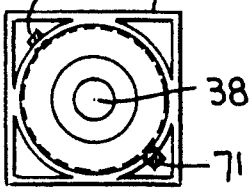
FIG. 14 is a front elevational view of the nozzle taken substantially along the line 14—14 of FIG. 12.
Figure 13:
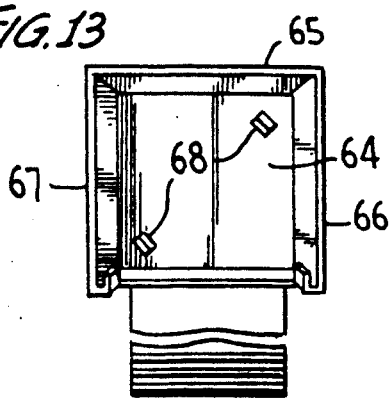
FIG. 13 is an elevational view taken substantially along the line 13—13 of FIG. 12.
Figure 12:
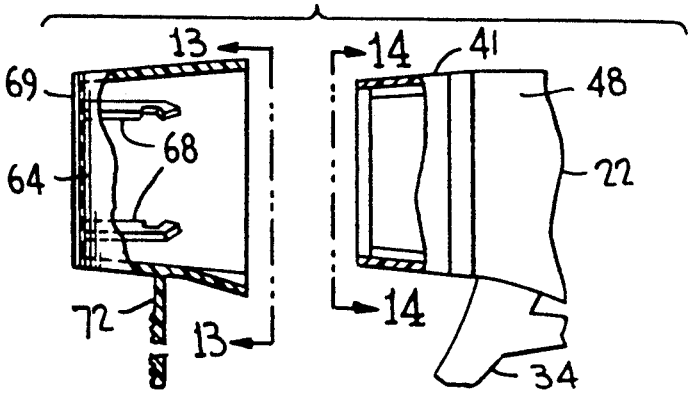
FIG. 12 is an expanded side elevational view, partly in section, of a pump sprayer and a locking element for the nozzle according to another embodiment of the invention.

In accordance with another embodiment of the invention cap 64 of FIGS. 12 and 13 is snap-fitted to nozzle 41 such that walls 65, 66, 67 of the cap overlie the corresponding flat surfaces 48, 49, 50 of the shroud cover. The cap functions to prevent nozzle rotation similarly as in the FIGS. 8–11 embodiment except that it is snap-fitted in place by the provision of tongues 68 extending from the inner face of a front wall 69 of the cap and having cut outs near the free ends thereof for snap-fitting engagement with ears 71 provided within the nozzle, as shown in FIG. 14. The cap may be removed by the provision of a pull tab 72 permitting the user to simply disengage the cap from the nozzle.

Although the invention has been described with reference to a nozzle of rectangular cross-section and corresponding flat faces of the shroud cover for initially preventing nozzle rotation from its OFF position, the invention is likewise adapted for preventing rotation of a nozzle of generally circular cross-section from its OFF position as part of a manually actuated sprayer having an arcuate shroud cover at its forward end adjacent the nozzle. Pump sprayer 20 of FIGS. 15, 16 may be similarly structured as pump sprayer 20 of FIGS. 1 and 2, or may be of the type disclosed in U.S. Pat. No. 4,204,614, commonly owned herewith. The entirety of the disclosure of that patent is therefore specifically incorporated herein by reference.

Figure 15:
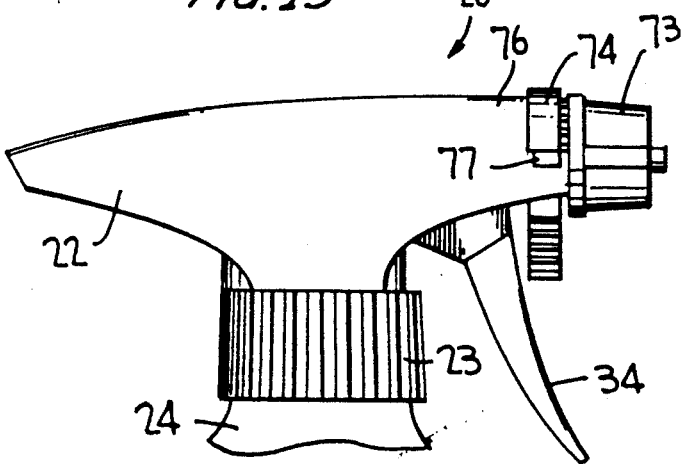
FIG. 15 is a side elevational view of a manually operated pump sprayer having a nozzle locking element according to another embodiment of the invention.
Figure 16:
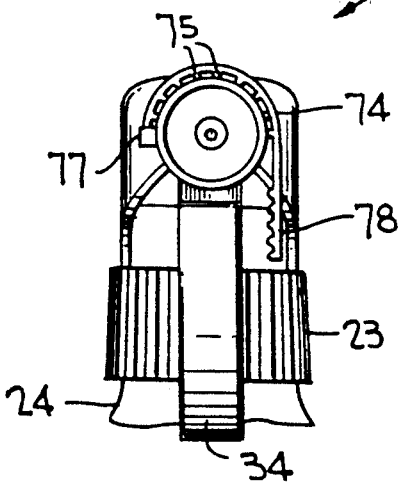
FIG. 16 is a front elevational view of the FIG. 15 sprayer and locking element.

The pump sprayer has a nozzle 73 of generally circular cross-section which is shown in FIGS. 15 and 16 in its OFF position in which the discharge is closed in a manner as disclosed in the U.S. Pat. No. 4,204,614. Tear strip 74 is connected along a curved edge of the nozzle by the provision of frangible connecting ties 75, the tear strip overlying a corresponding arcuate surface 76 of the shroud cover. The nozzle is screw threaded to the pump body for rotation to an ON position upon counterclockwise rotation of the nozzle when viewed in FIG. 16.

A projection 77 on the shroud cover functions as a stop preventing rotation of the nozzle from its OFF position in FIGS. 15 and 16, as a free end of the tear strip bears against the projection as shown. A pull tab 78 on the tear strip facilitates tear strip removal by exerting an outward pull to simply break the frangible connecting ties 75. Upon full removal of the tear strip, the nozzle can be rotated counterclockwise about its central axis from its OFF position to open the discharge to facilitate pump spraying.

Figure 17:
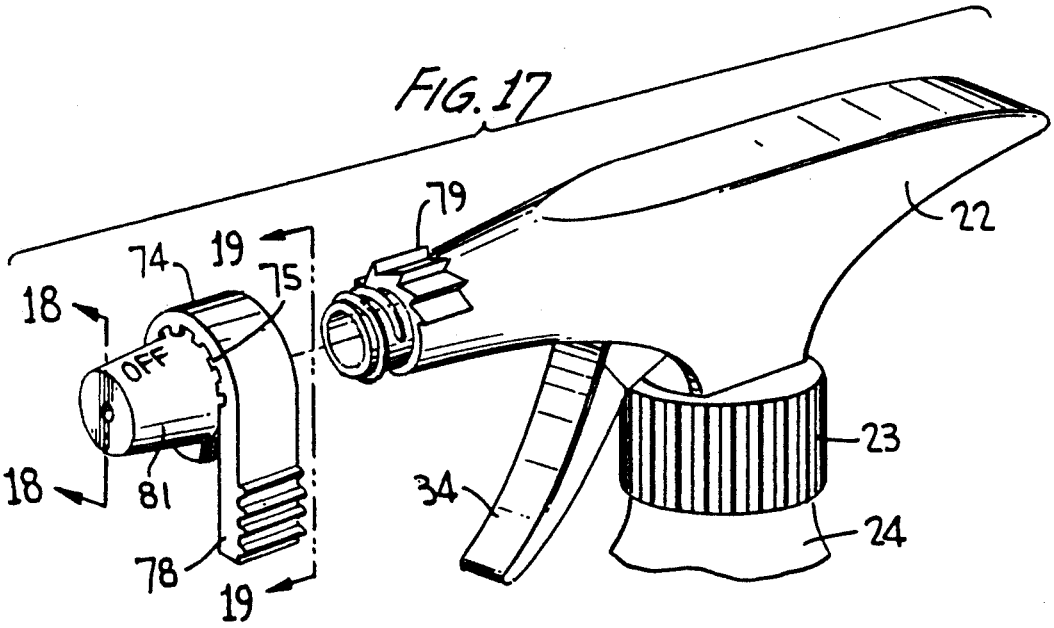
FIG. 17 is a perspective view of a sprayer similar to that of FIG. 15 having a stop element according to yet another embodiment of the invention, and showing the nozzle in expanded view with the removably attached locking element.
Figure 18:
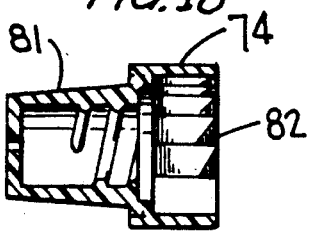
FIG. 18 is a sectional view taken substantially along the line 18—18 of FIG. 17.
Figure 19:
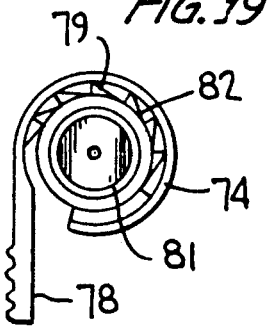
FIG. 19 is an elevational view taken substantially along the line 19—19 of FIG. 17.

A variant of the removable tear strip and projection stop of FIGS. 15, 16 is shown in FIGS. 17–19 wherein projection 77 is replaced by ratchet teeth 79 on the outer surface of the shroud cover at its forward end. Nozzle 81, which is threaded onto the pump body, has tear strip 74 connected along an arcuate edge thereof by frangible connecting ties 75, similarly as in FIG. 15. And, an inner surface of the tear strip is provided with ratchet teeth 82 which engage ratchet teeth 79 in the fully threaded position of the nozzle on the pump body. The cooperating teeth are one-way ratchet teeth preventing counterclockwise rotation of the nozzle, when viewed in FIG. 17. Thus, the nozzle is locked in its OFF position against rotation to an ON position, and nozzle rotation is facilitated by simply removing the tear strip upon pulling outwardly on tab 78.

From the foregoing it can be seen that a unique stop has been provided in various forms for preventing rotation of the nozzle of a manually actuated liquid pump sprayer from its discharge closed position thus providing a safety and tamper proof mechanism for pump sprayers while shelved or stored. The removable cap or the removable tear strip according to the invention requires a minimum number of parts making it highly efficient and economical.

Obviously, many other modifications and variations of the present invention are made possible in the light of the above teachings. For example, the invention is adapted for use in preventing initial rotation of the nozzle of pump sprayers other than that specifically disclosed herein, without departing from the invention. It is therefore to be understood that within the scope of the appended claims, the invention may be practiced otherwise than as specifically described.

What is claimed is:

1. A manually actuated liquid dispensing pump assembly comprising, a pump body for mounting with a closure cap to the upper end of a container for fluent product, said pump body extending transversely above the closure cap, a shroud cover on said body, said body having means defining a pump chamber having an inlet port in communication with a valve controlled inlet passage, said chamber having an outlet port in communication with a discharge passage extending in a forward direction through said body, a discharge nozzle having a discharge orifice in communication with said discharge passage, said nozzle being mounted on said body adjacent a forward end of said shroud cover for rotation in one direction from a discharge closed to a discharge open position and in an opposite direction from a discharge open to a discharge closed position upon manual rotation of said nozzle about a central axis thereof, manually operable means on said pump body for pressurizing said chamber for expelling product through said discharge orifice, a locking element removably connected to said nozzle by frangible connecting ties, rigid, non-resilient stop means comprising at least one protrusion on an outer surface of said shroud cover presenting at least one abutment wall lying at an angle to said surface of up to 90°, said element at least partially surrounding said outer surface of said shroud cover and having at least one shoulder lying parallel to said wall and bearing thereagainst in said discharge closed position for preventing rotation of said nozzle only in said one direction, and said shoulder being disengaged from said abutment wall upon removal of said locking element for permitting rotation of said nozzle in said one direction.

2. The assembly according to claim 1, wherein said stop means comprises a plurality of abutment walls each lying at said angle and together defining one-way ratchet teeth, said element having a plurality of shoulders each lying parallel to said walls and bearing thereagainst, said walls defining internal ratchet teeth engaging said abutment walls in said closed position.

* * * * *